US008184077B2

(12) United States Patent
Lee et al.

(10) Patent No.: US 8,184,077 B2
(45) Date of Patent: May 22, 2012

(54) LIQUID CRYSTAL DISPLAY DEVICE AND METHOD FOR IMPROVING COLOR REPRODUCIBILITY THEREOF

(75) Inventors: Don-Gyou Lee, Gyoungsangbok-Do (KR); Ki-Yon Song, Gyeonggi-Do (KP); Jung-Ho Kil, Gyoungsangbuk-Do (KR)

(73) Assignee: LG Display Co., Ltd, Seoul (KR)

( * ) Notice: Subject to any disclaimer, the term of this patent is extended or adjusted under 35 U.S.C. 154(b) by 447 days.

(21) Appl. No.: 10/691,312

(22) Filed: Oct. 23, 2003

(65) Prior Publication Data

US 2004/0125063 A1 Jul. 1, 2004

(30) Foreign Application Priority Data

Dec. 31, 2002 (KR) ..... 10-2002-0088455

(51) Int. Cl.
*G09G 3/36* (2006.01)
*G09G 5/10* (2006.01)
*G09G 5/02* (2006.01)

(52) U.S. Cl. ..... 345/89; 345/692; 345/590

(58) Field of Classification Search ..... 345/89, 345/589–590, 600–602; 349/74; 382/167; 348/649

See application file for complete search history.

(56) References Cited

U.S. PATENT DOCUMENTS

| | | | | | |
|---|---|---|---|---|---|
| 5,416,890 | A * | 5/1995 | Beretta | 345/590 |
| 5,677,741 | A * | 10/1997 | Yui | 345/601 |
| 6,008,786 | A * | 12/1999 | Kimura et al. | 345/89 |
| 6,188,454 | B1 * | 2/2001 | Greene et al. | 349/74 |
| 6,227,668 | B1 * | 5/2001 | McKinnon et al. | 351/222 |
| 7,046,255 | B2 * | 5/2006 | D'Souza et al. | 345/602 |

FOREIGN PATENT DOCUMENTS

| | | |
|---|---|---|
| JP | 2000-356790 | 12/2000 |
| JP | 2003-66896 | 3/2003 |

* cited by examiner

*Primary Examiner* — William Boddie
(74) *Attorney, Agent, or Firm* — McKenna Long & Aldridge LLP

(57) ABSTRACT

A liquid crystal display device and a method for improving a color reproducibility thereof, detects a gray scale value in applied image information that reduces a color reproducibility of a liquid crystal display device by measuring a gray scale level of a color displayed on a liquid crystal display panel while increasing the gray scale value of the color, and storing a maximum value of the gray scale level is displayable prior to reducing the color reproducibility. The applied image information is compensated to prevent reduction in the color reproducibility.

12 Claims, 8 Drawing Sheets

360

| | | | | | | | | | | | | | | | | | | | | | | |
|---|---|---|---|---|---|---|---|---|---|---|---|---|---|---|---|---|---|---|---|---|---|---|
| B | GRAY SCALE LEVEL | 64 | 63 | 62 | 61 | 60 | 59 | 58 | 57 | 56 | 55 | 54 | 53 | 52 | 51 | 50 | 49 | 48 | ••• | 3 | 2 | 1 |
| | GRAY SCALE VALUE | 50 | 50 | 50 | 50 | 50 | 50 | 50 | 50 | 50 | 50 | 50 | 50 | 50 | 50 | 49 | 48 | 47 | ••• | 2 | 1 | 0 |
| G | GRAY SCALE VALUE | 7 | 6 | 6 | 5 | 5 | 4 | 4 | 3 | 3 | 2 | 2 | 1 | 1 | 0 | 0 | 0 | 0 | ••• | 0 | 0 | 0 |
| R | GRAY SCALE VALUE | 6 | 6 | 5 | 5 | 4 | 4 | 3 | 3 | 2 | 2 | 1 | 1 | 0 | 0 | 0 | 0 | 0 | ••• | 0 | 0 | 0 |

FIG. 6

260

| B | | | | | | | | | | | | | | | | | | | | | | | | |
|---|---|---|---|---|---|---|---|---|---|---|---|---|---|---|---|---|---|---|---|---|---|---|---|---|
| GRAY SCALE LEVEL | 64 | 63 | 62 | 61 | 60 | 59 | 58 | 57 | 56 | 55 | 54 | 53 | 52 | 51 | 50 | 49 | 48 | ... | 3 | 2 | 1 |
| GRAY SCALE VALUE | 50 | 50 | 50 | 50 | 50 | 50 | 50 | 50 | 50 | 50 | 50 | 50 | 50 | 50 | 50 | 49 | 48 | 47 | ... | 2 | 1 | 0 |

FIG. 8

360

| | | | | | | | | | | | | | | | | | | | | | | |
|---|---|---|---|---|---|---|---|---|---|---|---|---|---|---|---|---|---|---|---|---|---|---|
| B | GRAY SCALE LEVEL | 64 | 63 | 62 | 61 | 60 | 59 | 58 | 57 | 56 | 55 | 54 | 53 | 52 | 51 | 50 | 49 | 48 | ••• | 3 | 2 | 1 |
| | GRAY SCALE VALUE | 50 | 50 | 50 | 50 | 50 | 50 | 50 | 50 | 50 | 50 | 50 | 50 | 50 | 50 | 49 | 48 | 47 | ••• | 2 | 1 | 0 |
| G | GRAY SCALE VALUE | 7 | 6 | 6 | 5 | 5 | 4 | 4 | 3 | 3 | 2 | 2 | 1 | 1 | 0 | 0 | 0 | 0 | ••• | 0 | 0 | 0 |
| R | GRAY SCALE VALUE | 6 | 6 | 5 | 5 | 4 | 4 | 3 | 3 | 2 | 2 | 1 | 1 | 0 | 0 | 0 | 0 | 0 | ••• | 0 | 0 | 0 |

LIQUID CRYSTAL DISPLAY DEVICE AND METHOD FOR IMPROVING COLOR REPRODUCIBILITY THEREOF

This application claims the benefit of the Korean Application No. P2002-88455 filed on Dec. 31, 2002, which is hereby incorporated by reference for all purposes as if fully set forth herein.

BACKGROUND OF THE INVENTION

1. Field of the Invention

The present invention relates to liquid crystal display (LCD) devices and a method for improving color reproducibility thereof, and more particularly to an LCD device and a method for improving a color reproducibility of an LCD device, wherein colors are displayable by the LCD panel by mixing red, green, and blue colors displayable at multiple gray scale levels.

2. Discussion of the Related Art

Flat thin film-type displays express color images, are lightweight, and portable display devices. Liquid crystal display (LCD) devices in particular are capable of displaying pictures at high resolutions, have fast response speeds, and are therefore capable of displaying of moving pictures. Accordingly, research on the design and manufacture of LCD devices is actively performed.

Color LCD devices operate according to anisotropic optical characteristics and polarization properties of liquid crystal molecules. More specifically, alignment directions of liquid crystal molecules with anisotropic optical characteristics can be manipulated to selectively transmit light. Active matrix LCD (AM-LCD) devices display pictures at a high quality and are formed using thin film transistors (TFTs) connected to pixel electrodes arranged in a matrix pattern. A structure of general LCD device will now be described in greater detail.

A related art LCD device generally includes an LCD panel having a color filter panel and an opposing TFT array panel both formed of transparent substrate material. The color filter and TFT array panels are disposed a predetermined distance from each other to define a cell gap. A layer of liquid crystal material is formed within the cell gap. The color filter panel supports red, green, and blue color filters sequentially arranged at positions corresponding to the pixel electrodes, a black matrix having a net-type shape formed between the color filters, and a common electrode formed on the color filters. The TFT array panel supports pixel electrodes arranged at pixel positions provided in a matrix pattern, gate lines formed along a horizontal direction of the pixel electrodes, data lines formed along a vertical direction of the pixel electrodes, and TFTs for driving the pixel electrodes formed at sides of the pixel electrodes. Each TFT includes a gate electrode connected to the corresponding gate line and a source electrode connected to the corresponding data line. Moreover, pad units, formed at ends of the gate and data lines, are used to connect the TFTs to external driving circuits.

FIG. 1 illustrates a schematic view of a related art liquid crystal display panel and a related art driving unit.

Referring to FIG. 1, red (R), green (G), and blue (B) image information (DATA) and control signals (CS) are applied to a timing control unit 120 via an interface unit 110. A system power (VCC) is applied to the timing control unit 120 and a power unit 130.

The timing control unit 120 applies the control signal (CS) to a gate driving unit 140 and applies the image information (DATA) and the control signal (CS) to a data driving unit 150. The control signal (CS) includes a clock signal, a gate start signal, and a timing signal and enables the timing control unit 120 to control a driving timing of the gate and data driving units 140 and 150.

The power unit 130 receives the system power (VCC), applies gate on/off power ($V_{G\text{-}ON}$, $V_{G\text{-}OFF}$) to the gate driving unit 140, applies a reference voltage ($V_{REF}$) to the data driving unit 150, and applies a common voltage ($V_{COM}$) to the common electrode of the LCD panel 100.

The gate driving unit 140 receives the control signal (CS) applied by the timing control unit 120 and the gate on/off power ($V_{G\text{-}ON}$, $V_{G\text{-}OFF}$) applied by the power unit 130 and applies scan signals to the gate lines of the LCD panel 100.

The data driving unit 150 receives the control signal (CS) and the image information (DATA) applied by the timing control unit 120 and the reference voltage ($V_{REF}$) applied by the power unit 130 and applies the image information (DATA) to the data lines of the LCD panel 100.

Pixels in the LCD panel 100 are arranged in a matrix pattern and express light of predetermined colors in accordance with the applied image information (DATA), applied by the data driving unit 150 in accordance with the scan signals applied by the gate driving unit 140. R, G, and B image information (DATA) are applied to corresponding ones of R, G, and B pixels, wherein R, G, and B pixels constitute one dot within a display area of LCD panel 100. By combining light expressed by the R, G, and B pixels, predetermined colors may be displayed by the LCD panel 100.

To display natural-type colors, R, G, and B colors must be expressed by the LCD panel 100 at multiple gray scale levels. For example, when R, G, and B colors (i.e., the three primary colors primary colors) are expressed by the LCD panel 100 without using gray scale levels, only $2^3$ (i.e., 8) colors (black, red, green, blue, white, red+green, green+blue, and blue+red) are expressable by a dot of the LCD panel 100. However, when R, G, and B colors are expressed by the LCD panel 100 at an 8-bit gray scale level, $2^{24}$ (i.e., 16,777,216) colors are expressable by a dot of the LCD panel 100. Accordingly, R, G, and B colors expressable using multiple gray scale levels can be mixed together to generate natural colors.

FIG. 2 illustrates an X-Y chromaticity diagram, quantitatively illustrating natural colors.

Referring to FIG. 2, the color and degree of color saturation can be uniquely described according to the X-Y coordinates of the chromaticity diagram. Light having chromatic values on and within the closed, horseshoe-shaped region C-100 is viewable by humans. Light having chromatic values within the triangular region T-100 defined by "R," "G," and "B" vertices is displayable using an NTSC fluorescent lamp. Accordingly, light within the triangular region T-100 may express color that is reproducible. Light having chromatic values defined by the R1, G1, and B1 distributions are expressed as red, green, and blue colors, respectively, and are displayable by the LCD panel 100 at multiple gray scale levels.

More specifically, when the gray scale level of light having a red color displayed by the related art LCD device is increased, in the chromaticity diagram, the R1 distribution is generated. When the gray scale level of light having a green color displayed by the related art LCD device is increased, in the chromaticity diagram, the G1 distribution is generated. When the gray scale level of light having a blue color displayed by the related art LCD device is increased, in the chromaticity diagram, the B1 distribution is generated.

As the gray scale level of the blue color displayed by the related art LCD device increases, the end portion of the B1 distribution deviates along the Y-axis, away from the "B" vertex of the color reproduction region T-100. Accordingly, as the gray scale level of light having a blue color displayed by the related art LCD device increases, the degree to which the blue color is reproducible decreases. The phenomenon by which the color reproducibility is decreased upon increasing the gray scale level of light having the blue color will now be described in greater detail below.

FIG. 3 illustrates a graph of a Gooch-Tarry curve, indicating a difference in transmissivity of R, G, and B colors through the cell gap of the LCD device.

R, G, B colors have different wavelengths within a visible wavelength region. Similarly, and with reference to FIG. 3, R, G, and B colors are transmitted by the LCD device according to the cell gap and a refractive index of the liquid crystal material provided within the cell gap. Accordingly, distortion of colors expressed by the LCD device may occur. For example, transmissivity characteristics of light having blue color are reduced when transmitted through a normal cell gap. Accordingly, the gray scale level of the blue color must be increased. However, as the gray scale level of the blue color increases, the end of the B1 distribution undesirably deviates along the Y-axis, away from the "B" vertex of the color reproduction region T-100 shown in FIG. 2.

Therefore, within the related art LCD device, color reproducibility of light having blue color decreases as the gray scale level of the blue color displayed by the related art LCD device increases. Due to the aforementioned transmissivity and reproducibility characteristics of light having the blue color, the quality with which the LCD device displays pictures is lowered and the overall desirability of the LCD device may be reduced.

SUMMARY OF THE INVENTION

Accordingly, the present invention is directed to a liquid crystal display device and a method for improving color reproducibility thereof that substantially obviates one or more of the problems due to limitations and disadvantages of the related art.

An advantage of the present invention provides an LCD device and a method for improving a color reproducibility of an LCD device and for facilitating of the display of colors by mixing red, green, and blue colors at multiple gray scale levels.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device may, for example, include a liquid crystal display panel having gate lines and data lines, wherein the gate lines cross the data lines, and wherein R, G, and B pixels are arranged in a matrix pattern defined by crossings of the gate and data lines; a gate driving unit for applying scan signals to the gate lines; a lookup table for storing a gray scale value corresponding to a maximum gray scale level of light having a color displayable by the liquid crystal display panel prior to a reduction in a color reproducibility of the color, wherein the color is displayable at multiple gray scale levels, and wherein the color includes at least one of a red (R), green (G), and blue (B) color; a data processing unit for compensating image information according to the gray scale value stored by the lookup table; and a data driving unit for receiving the compensated image information and for applying the compensated image information to the data lines of the liquid crystal display panel.

In accordance with the principles of another aspect of the present invention, a method for improving a color reproducibility of a color liquid crystal display device may, for example, include detecting a gray scale value at which a color reproducibility of light displayable by a liquid crystal display panel is decreased, wherein the detecting includes measuring a gray scale level of color displayed on the liquid crystal display panel while increasing a gray scale value of at least one of R, G, B colors displayed on the liquid crystal display panel; storing the gray scale value immediately preceding the decreasing of the color reproducibility; compensating image information using the stored gray scale value; and applying the compensated image information to data lines of the liquid crystal display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 6 illustrates an exemplary lookup table relating gray scale levels of blue colors having 64 gray scale levels, displayable by a liquid crystal display panel, to corresponding gray scale values.

FIG. 8 illustrates an exemplary lookup table relating gray scale levels of R, G, and B colors, displayable by a liquid crystal display panel, to corresponding gray scale values.

DETAILED DESCRIPTION OF THE ILLUSTRATED EMBODIMENTS

Reference will now be made in detail to embodiments of the present invention, examples of which are illustrated in the accompanying drawings.

Figure 4:
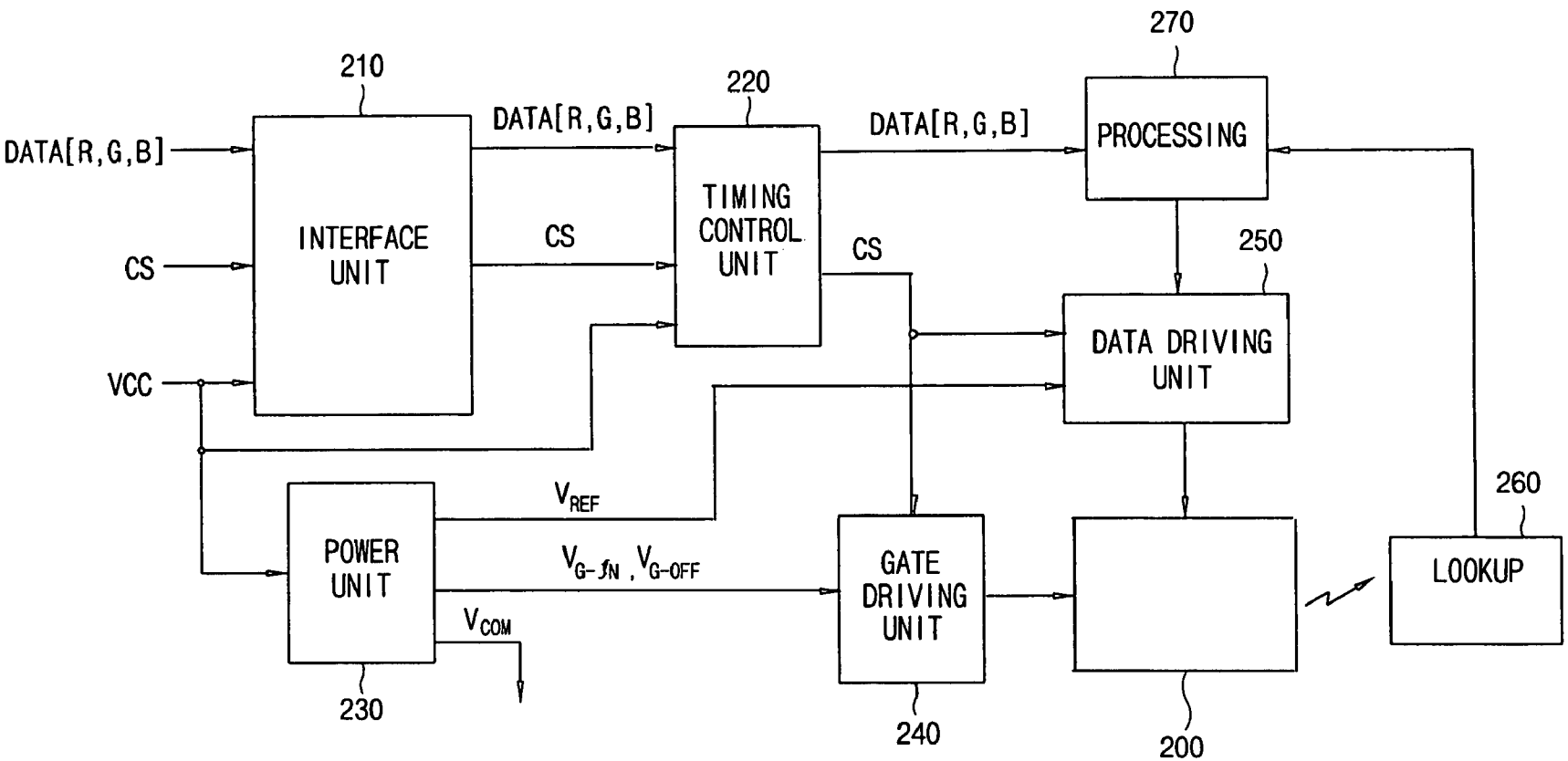
FIG. 4 illustrates a schematic view of an LCD panel and driving unit in accordance with principles of a first aspect of the present invention.
Figure 5:
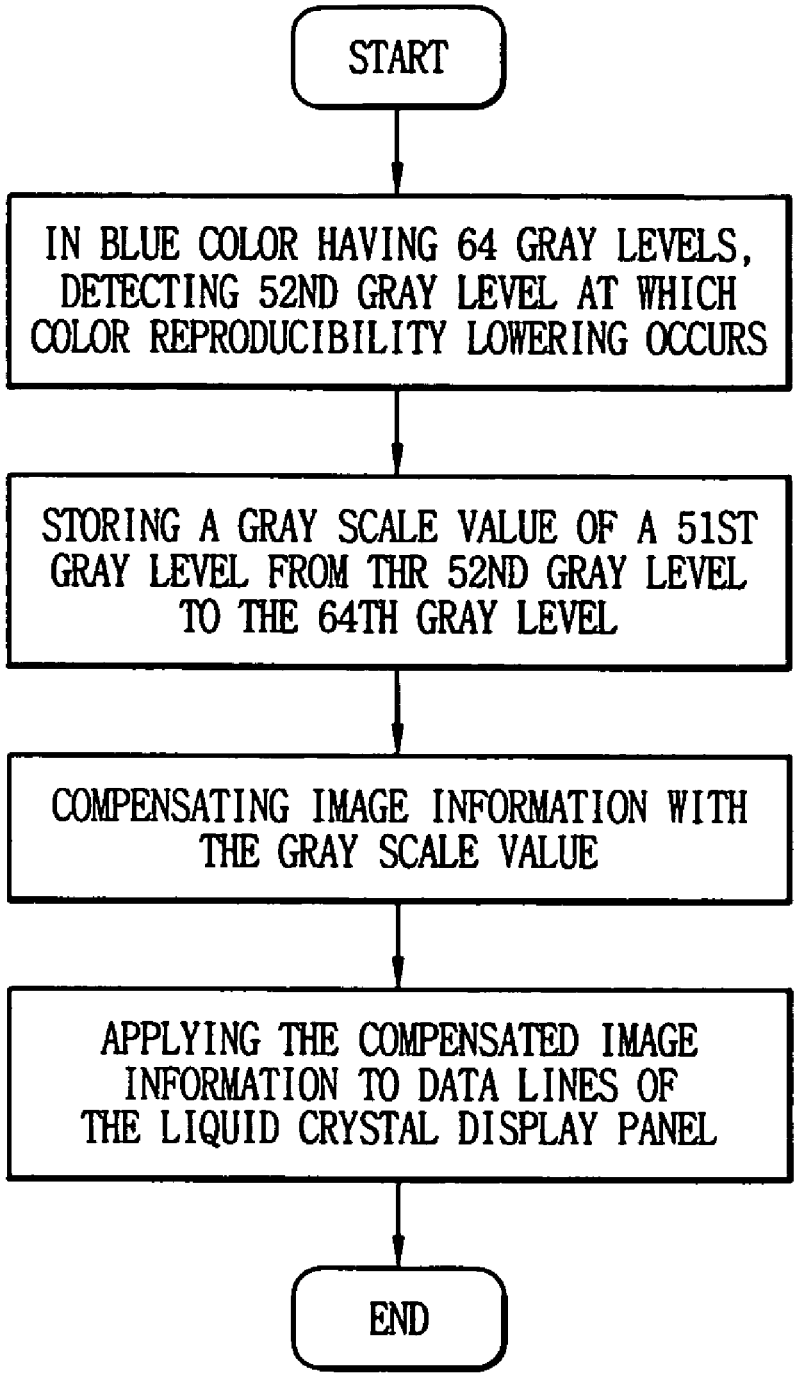
FIG. 5 illustrates a method for improving a color reproducibility of an LCD device in accordance with principles of a first aspect of the present invention.

FIG. 4 illustrates a schematic view of an LCD panel and driving unit in accordance with principles of a first aspect of the present invention. FIG. 5 illustrates a method for improving a color reproducibility of an LCD device in accordance with principles of a first aspect of the present invention.

Referring to FIGS. 4 and 5, R, G, and B image information (DATA) and control signals (CS) may be applied to a timing control unit 220 via an interface unit 210. A system power (VCC) may be applied to the timing control unit 220 and a power unit 230.

The timing control unit 220 may apply the control signal (CS) to a gate driving unit 240 and a data driving unit 250. Further, the timing control unit 220 may apply the image information (DATA) to a data processing unit 270. In one aspect of the present invention, the control signal (CS) may include a clock signal, a gate start signal, and a timing signal and may control a driving timing of the gate and data driving units 240 and 250, respectively.

The power unit 230 may receive the system power (VCC) and apply a gate on/off power ($V_{G\text{-}ON}$, $V_{G\text{-}OFF}$) to the gate driving unit 240, apply a reference voltage ($V_{REF}$) to the data driving unit 250, and apply a common voltage ($V_{COM}$) to a common electrode of a liquid crystal display (LCD) panel 200.

In one aspect of the present invention, the gate driving unit 240 may receive the control signal (CS) applied by the timing control unit 220 and the gate on/off power ($V_{G\text{-}ON}$, $V_{G\text{-}OFF}$) applied by the power unit 230. Further, the gate driving unit 240 may sequentially apply scan signals to the gate lines of the liquid crystal display panel 200.

In accordance with the principles of the present invention, a blue color having 64 gray scale levels may be displayable by the LCD panel 200. In one aspect of the present invention, the gray scale level of the blue color displayable by the LCD panel 200 may be increased from a $1^{st}$ gray scale level to a $64^{th}$ gray scale level. By increasing a gray scale value of the blue color displayed by the LCD panel 200, the gray scale level of the blue color displayed by the LCD panel 200 may be increased. Further, upon increasing the gray scale value of the blue color displayed by the LCD panel 200, the color reproducibility of the displayed blue color may be measured. Accordingly, the gray scale value at which the color reproducibility of the displayed blue color decreases may be detected using a lookup table 260.

For example, light having a blue color may be displayable by the LCD panel 200 at 64 gray scale levels. Moreover, color reproducibility of light displayed by the LCD panel 200 may be measured while increasing the gray scale value.

Referring to FIG. 6, color reproducibility of blue colored light may decrease when the gray scale level of the displayed blue color increases to the $\mathbf{52}^{nd}$ gray scale level. According to the lookup table 260, blue color is displayable by the LCD panel 200 at the $\mathbf{51}^{st}$ gray scale level immediately before it is displayable by the LCD panel 200 at the $\mathbf{52}^{nd}$ gray scale level. Therefore, blue color may be displayed by the LCD panel 200 at the $\mathbf{51}^{st}$ gray scale level immediately before the reproducibility of the displayed blue color decreases. Within the lookup table 260, a gray scale value of 50 corresponds to the $\mathbf{52}^{nd}$ gray scale level displayable by the LCD panel 200 (e.g., the displayed gray scale level where color reproducibility of the blue color is lowered) up to the $\mathbf{64}^{th}$ gray scale level displayable by the LCD panel 200 (e.g., the highest gray scale level).

According to the principles of the present invention, the data processing unit 270 may compensate image information (DATA) applied by the timing control unit 220 in accordance with the gray scale values stored in the lookup table 260. For example, when the received image information (DATA) corresponds to a blue color displayable by the LCD panel 200 at a gray scale level greater than the $52^{nd}$ gray scale level, the data processing unit 270 may compensate the gray scale value within the image information (DATA) in accordance with the gray scale value and levels stored in the lookup table 260. Accordingly, the data processing unit 270 may compensate the image information (DATA) such that a blue color may be displayed by the LCD panel 200 at a gray scale level equal to the $\mathbf{51}^{st}$ gray scale level. Therefore, the image information may be compensated to include a gray scale value corresponding to the $51^{st}$ gray scale level. In one aspect of the present invention, the compensated image information (DATA) and the reference voltage ($V_{REF}$) may be applied by the data processing unit 270 and the power unit 230, respectively, to the data driving unit 250. In accordance with the control signal (CS) applied from the timing control unit 220, the driving timing of the gate and data driving units 240 and 250, respectively, may be controlled. As a result, the compensated image information (DATA) may be applied to the data lines of the LCD panel 200.

According to the principles of the first aspect of the present invention, gray scale values within image information can be compensated by detecting the increased blue color gray scale level accompanying a decrease in color reproducibility. The decrease in color reproducibility may be determined by measuring the gray scale level of the color displayed by the LCD panel. Upon measuring the decrease in color reproducibility, corresponding gray scale values within the image information may be stored such that the gray scale value applied immediately prior to the decrease in color reproducibility may be determined.

Figure 7:
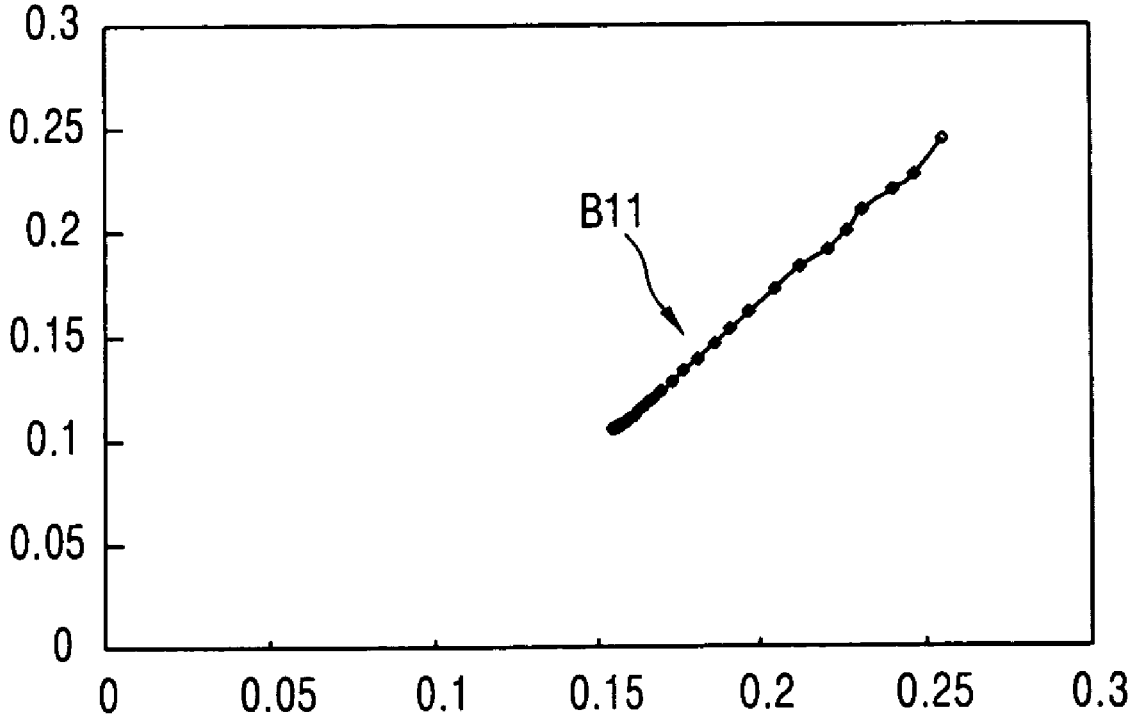
FIG. 7 illustrates a graph of increases in a gray scale level of light having a blue color, displayable by a liquid crystal display panel, according to gray scale values stored in the lookup table shown in FIG. 6.

FIG. 7 illustrates a graph of increases in a gray scale level of light having a blue color, displayable by a liquid crystal display panel, according to gray scale values stored in the lookup table shown in FIG. 6

Figure 1:
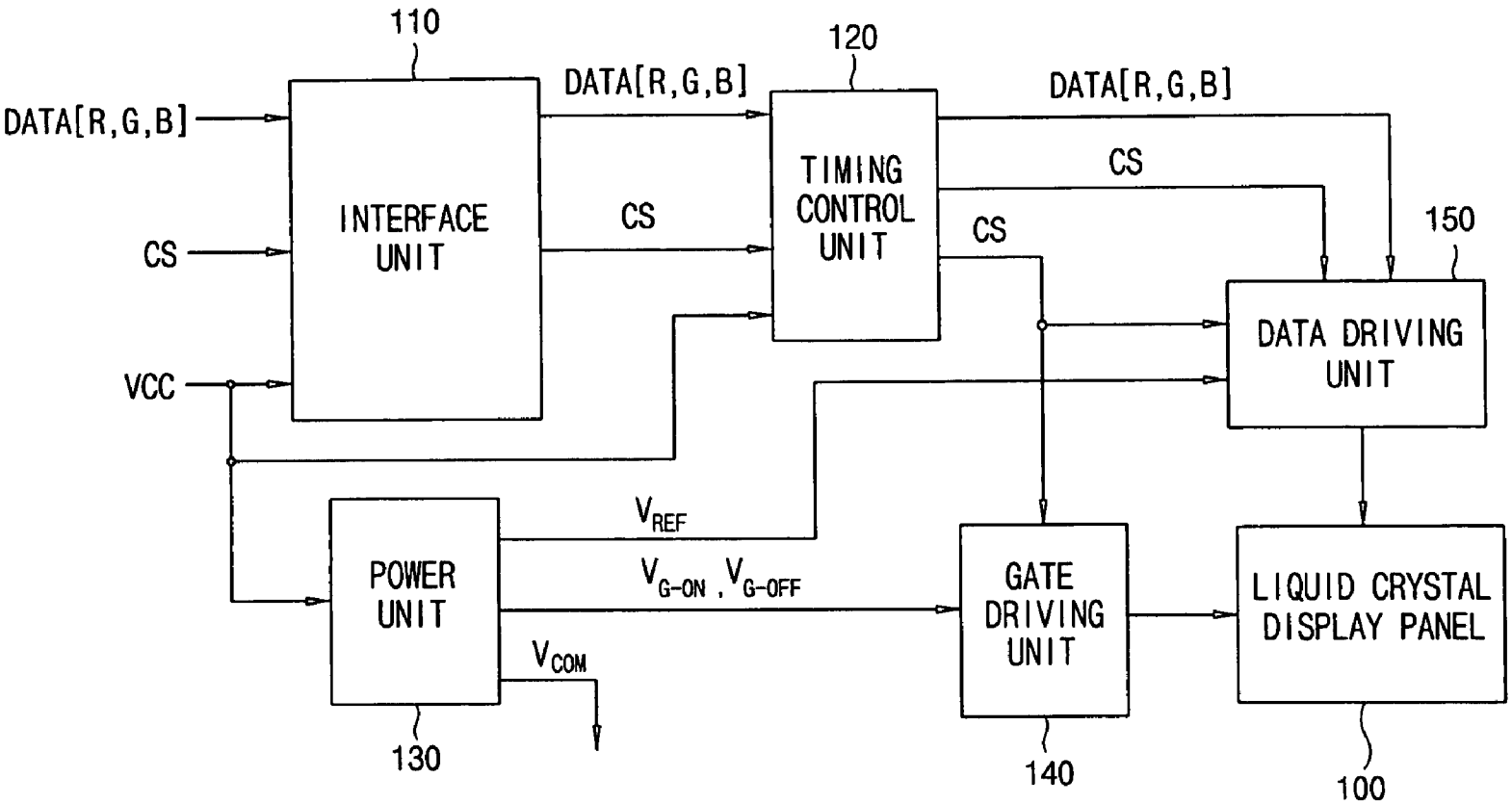
FIG. 1 RELATED ART
FIG. 1 illustrates a schematic view of a related art liquid crystal display panel and a related art driving unit.
Figure 2:
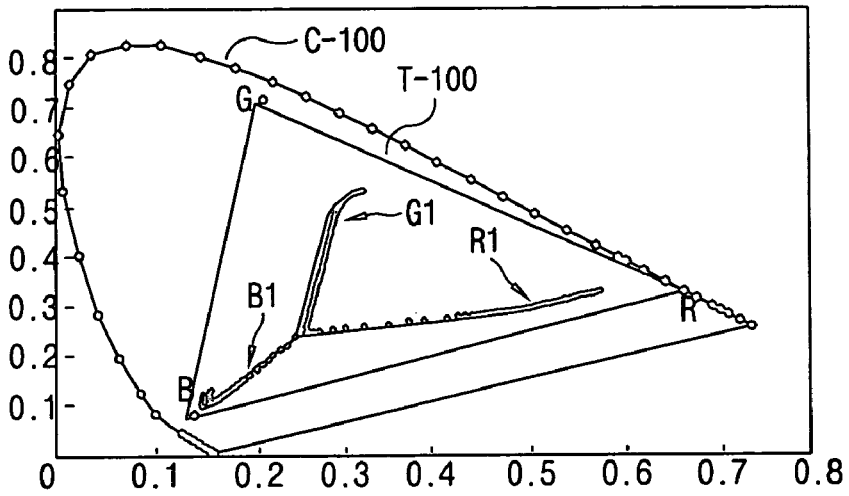
FIG. 2 RELATED ART
FIG. 2 illustrates an X-Y chromaticity diagram, quantitatively illustrating natural colors.
Figure 3:
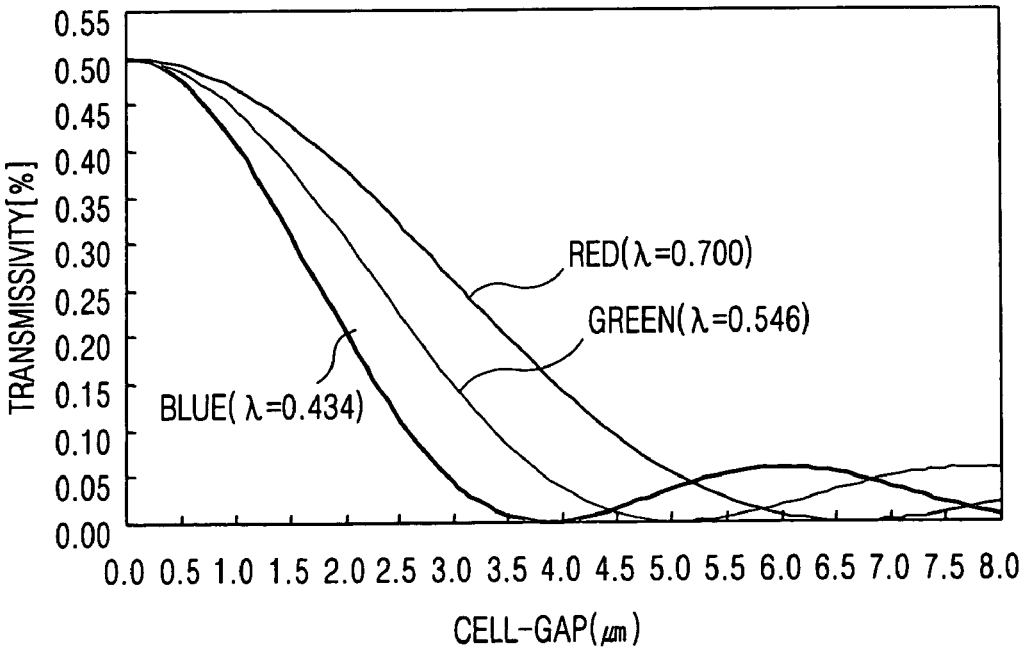
FIG. 3 RELATED ART
FIG. 3 illustrates a graph of a Gooch-Tarry curve, indicating a difference in transmissivity of R, G, and B colors through the cell gap of the LCD device.

Referring to FIG. 7, upon increasing the gray scale level of the blue color displayable by the LCD panel 200 in accordance with an increase in a gray scale value, a distribution shown at B11 may be obtained. As shown in the Figure, the Y-axis distortion discussed above with reference to the end portion of the B1 distribution of FIG. 2 may be substantially prevented. Accordingly, the principles of the present invention may substantially prevent the color reproducibility from being decreased.

FIG. 8 illustrates an exemplary lookup table relating gray scale levels of R, G, and B colors, displayable by a liquid crystal display panel, to corresponding gray scale values.

Referring to FIG. 8, a blue color having 64 gray scale levels may be displayable by an LCD panel. In one aspect of the present invention, the gray scale level of the blue color displayable by the LCD panel 200 may be increased from a $\mathbf{1}^{st}$ gray scale level to a $\mathbf{64}^{th}$ gray scale level. By increasing the gray scale value of the blue color, the gray scale level of the blue color displayed by the LCD panel 200 may be increased. Further, upon increasing the gray scale value of the blue color displayed by the LCD panel, the color reproducibility of the displayed blue color may be measured. Accordingly, the gray scale value at which the color reproducibility decreases may be detected using a lookup table 360. According to the lookup table 360, the blue color is displayable by the LCD panel at the $51^{st}$ gray scale level immediately before it is displayable by the LCD panel 200 at the $\mathbf{52}^{nd}$ gray scale level. Accordingly, blue color may be displayed by the LCD panel at the $\mathbf{51}^{st}$ gray scale level immediately before the reproducibility of the displayed blue color decreases. Within the lookup table 360, a gray scale value of 50 corresponds to the $\mathbf{52}^{nd}$ gray scale level displayable by the LCD panel 200 (e.g., the color reproducibility of the blue color is lowered) up to the 64$^{th}$ gray scale level displayable by the LCD panel (e.g., the highest gray scale level).

Additionally, light having a green color may be displayed by the LCD panel at gray scale levels of 1, 1, 2, 2, 3, 3, 4, 4, 5, 5, 6, 6, and 7. Moreover, light having a red color may be displayed by the LCD panel at gray scale levels of 1, 1, 2, 2, 3, 3, 4, 4, 5, 5, 6, and 6. In one aspect of the present invention, the gray scale levels of the green and red colors may be mixed with corresponding ones of the 52$^{nd}$ to 64$^{th}$ gray scale levels of the blue color. For example, when the received image information (DATA) corresponds to a blue color displayable by the LCD panel 200 at a gray scale level greater than the 52$^{nd}$ gray scale level, light having a green color may be displayed by the LCD panel at gray scale levels of 1, 1, 2, 2, 3, 3, 4, 4, 5, 5, 6, 6, or 7 and/or light having a red color may be displayed by the LCD panel at gray scale levels of 1, 1, 2, 2, 3, 3, 4, 4, 5, 5, 6, or 6 may be mixed with the received image information to ensure reproducibility of the blue color displayable by the LCD panel.

According to the principles of the second aspect of the present invention, color reproducibility of light displayed by LCD panels may be measured as the gray scale level of the displayed light is increased. Accordingly, a gray scale value within the image information (DATA), corresponding to a gray scale level displayed by the LCD panel immediately before the color reproducibility is reduced, may be determined. Within the lookup table 360, a gray scale value of 50 corresponds to the 52$^{nd}$ gray scale level displayable by the LCD panel (e.g., the displayed gray scale level where color reproducibility of the blue color is lowered) up to the 64$^{th}$ gray scale level displayable by the LCD panel (e.g., the highest gray scale level).

Figure 9:
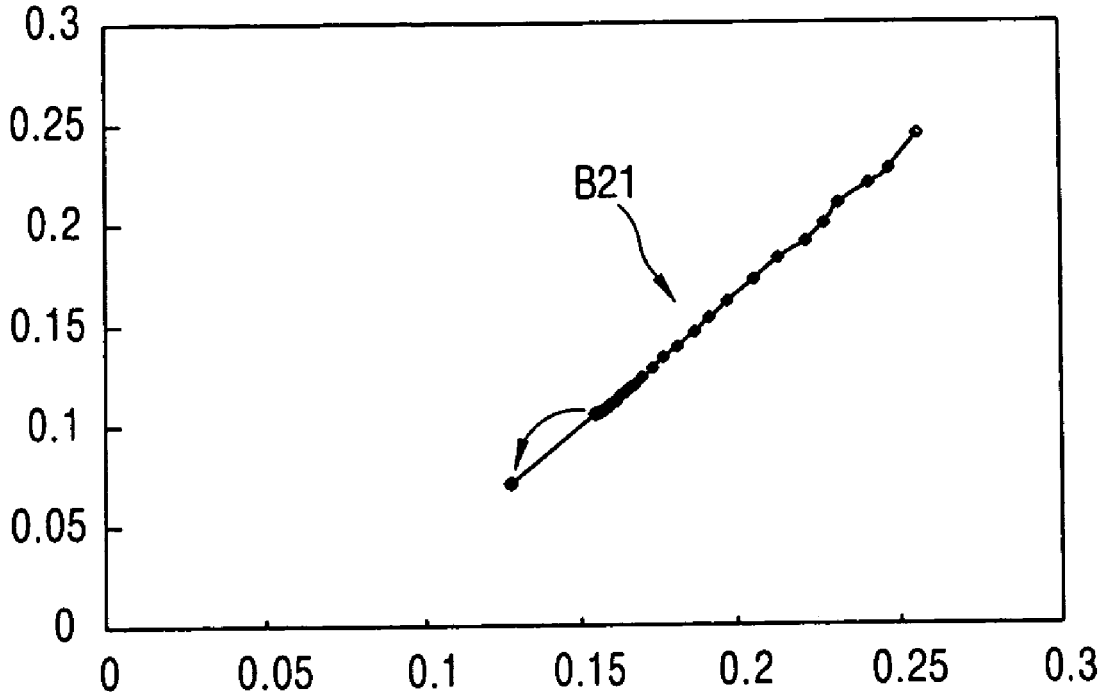
FIG. 9 illustrates a graph of increases in a gray scale level of light having a blue color, displayable by a liquid crystal display panel, according to gray scale values stored in the lookup table shown in FIG. 8.

Referring to FIG. 9, upon mixing gray scale levels of red and green colors, and upon increasing the gray scale level of the blue color displayable by the LCD panel in accordance with an increase in a gray scale value, a distribution shown at B21 may be obtained. As shown in the Figure, the Y-axis distortion discussed above with reference to the end portion of the B1 distribution of FIG. 2 may be substantially prevented. Further, according to the principles of the present invention, the end portion of the B21 distribution shown in FIG. 9 is closer to the "B" vertex of the color reproduction region (T-100) of the NTSC fluorescent lamp shown in FIG. 2 than the end portion of the B11 distribution shown in FIG. 7. Therefore, the degree to which color reproducibility may be improved according to the second aspect of the present invention may be improved compared to the degree to which color reproducibility may be improved according to the first aspect of the present invention.

As described above, color reproducibility of light displayed by LCD panels may be measured as the gray scale level of the displayed light is increased. Accordingly, a gray scale value within the image information (DATA), corresponding to a gray scale level displayable by the LCD panel immediately before a color reproducibility is decreased, may be determined. Further, the gray scale value corresponding to the maximum gray scale level displayed by the LCD panel at which the color reproducibility is not reduced, may be stored in a lookup table. Accordingly, image information, including a gray scale value corresponding to a gray scale level displayable by an LCD panel at which a color reproducibility is reduced, may be compensated such that color may be displayed by the LCD panel at a gray scale level equal to the maximum gray scale level. The principles of the present invention may be applied to substantially prevent a reduction in color reproducibility caused by distortion of the Y-axis of the chromaticity diagram as the gray scale level of a blue color displayable by an LCD panel is increased. Moreover, a picture quality of an LCD device may be improved, and the overall desirability of the LCD device may be improved.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel having a plurality of gate lines and data lines crossing each other, and having red (R), green (G) and blue (B) pixels arranged in a matrix pattern;

a light source transmitting light through the R, G, and B pixels creating red, green, and blue colors respectively;

a gate driving unit for applying scan signals to the gate lines;

a lookup table for storing gray scale values of image information including R, G and B data, where a gray scale value of a gray level of the B data that is lower than a gray level at which a color saturation is reduced, is stored as a gray scale value of gray levels that are higher than the gray level at which the color saturation is reduced, wherein the lookup table includes a same initial gray scale value of at least one of the R and G data for all gray levels prior to a gray level at which the color saturation is reduced and the lookup table includes different gray scale values of the R and G data to mix with the B gray scale values from a gray level at which the color saturation is reduced to an uppermost gray level;

a data processing unit for compensating image information according to the gray scale values in the lookup table; and a data driving unit for receiving the compensated image information and applying the compensated image information to the data lines.

2. The LCD device of claim 1, wherein the gray scale value of the gray levels of the B data prior to a gray level at which a color saturation is reduced is the same as the gray scale value of the gray levels from the gray level at which a color reproducibility is reduced to the uppermost gray level.

3. The LCD device of claim 1, wherein the B data has 64 gray levels.

4. The LCD device of claim 1, wherein the gray level at which a color saturation is reduced among the B data is a 52$^{nd}$ gray level.

5. The LCD device of claim 1, wherein the gray level prior to a gray level where a color saturation is reduced among the B data is a 51$^{st}$ gray level.

6. A method for improving a color reproducibility of a liquid crystal display (LCD) device, the method comprising:

detecting a gray scale value of a gray level at which a color saturation is reduced, and a gray scale value of a gray level that is lower than the gray level at which a color saturation is reduced, by measuring a color displayed on a liquid crystal panel with increasing gray scale values of B data among image information including R, G and B data;

storing the gray scale value of the gray level of the B data that is lower than the gray level at which a color saturation is reduced, as a gray scale value of gray level that are higher than the gray level at which a color saturation is reduced;

storing a same initial gray scale value of at least one of the R and G data for all gray levels prior to a gray level at which a color saturation is reduced and including different gray scale values of the R and G data to mix with the B gray scale values from a gray level at which the color saturation is reduced to an uppermost gray level;

compensating the image information according to the gray level and mixing the gray scale values of at least two of R, G, and B data; and applying the compensated image information to data lines of the liquid crystal panel.

7. The method of claim 6, wherein the gray scale value of the gray level prior to the gray level at which a color saturation is reduced is same as the gray scale value of gray levels from the gray level at which a color saturation is reduced to the uppermost bit.

8. The method of claim 6, wherein the B data has 64 gray levels.

9. The method of claim 6, wherein the gray level at which a color saturation is reduced among the B data is a $52^{nd}$ gray level.

10. The method of claim 6, wherein the gray level prior to a gray level where a color saturation is reduced among the B data is a $51^{st}$ gray level.

11. The liquid crystal display device of claim 1, wherein the lookup table includes the same initial gray scale value for both R and G data.

12. The method of claim 6, wherein the same initial gray scale value is the same for both the R and G data.

* * * * *